US008890882B2

(12) United States Patent
Goldthwaite et al.

(10) Patent No.: US 8,890,882 B2
(45) Date of Patent: Nov. 18, 2014

(54) COMPUTERIZED METHOD AND SYSTEM FOR GENERATING A DISPLAY HAVING A PHYSICAL INFORMATION ITEM AND AN ELECTRONIC INFORMATION ITEM

(75) Inventors: Flora P. Goldthwaite, Seattle, WA (US); Jonathan C. Cluts, Sammamish, WA (US); Gregory L. Hendrickson, Seattle, WA (US)

(73) Assignee: Microsoft Corporation, Redmond, WA (US)

( * ) Notice: Subject to any disclaimer, the term of this patent is extended or adjusted under 35 U.S.C. 154(b) by 2193 days.

(21) Appl. No.: 11/068,106

(22) Filed: Feb. 28, 2005

(65) Prior Publication Data

US 2006/0195331 A1 Aug. 31, 2006

(51) Int. Cl.
*G09G 5/00* (2006.01)
*G06Q 99/00* (2006.01)

(52) U.S. Cl.
CPC ..... *G06Q 99/00* (2013.01)
USPC ..... 345/581

(58) Field of Classification Search
USPC ..... 715/781, 807
See application file for complete search history.

(56) References Cited

U.S. PATENT DOCUMENTS

| | | | | |
|---|---|---|---|---|
| 5,455,906 | A * | 10/1995 | Usuda | 345/536 |
| 6,320,597 | B1 * | 11/2001 | Ieperen | 345/629 |
| 6,674,426 | B1 * | 1/2004 | McGee et al. | 345/173 |
| 2001/0010525 | A1 * | 8/2001 | Fukuda et al. | 345/788 |
| 2002/0191029 | A1 * | 12/2002 | Gillespie et al. | 345/810 |
| 2005/0024341 | A1 * | 2/2005 | Gillespie et al. | 345/173 |
| 2005/0261011 | A1 * | 11/2005 | Scott | 455/466 |

OTHER PUBLICATIONS

Jun Rekimoto, Brygg Ullmer & Haruo Oba; "Data Tiles: A Modular Platform for Mixed Physical and Graphical Interactions," ACM Proceedings of the Conference on Human Factors in Computing Systems 2001, Seattle, Washington, Mar. 31-Apr. 5, 2001, pp. 269-276.*

Klemmer et al. "The Designers' Outpost: A Tangible Interface for Collaborative Web Site Design," ACM UIST 2001, The 14th Annual ACM Symposium on User Interface Software and Technology, Orlando, FL, Nov. 11-14, 2001, pp. 1-10.*

* cited by examiner

*Primary Examiner* — Edward Martello

(74) *Attorney, Agent, or Firm* — Micah Goldsmith; Peter Taylor; Mickey Minhas

(57) ABSTRACT

Methods and systems for generating a display, for instance, on an integrated message board, the display having at least one physical information item and at least one electronic information item are provided. The physical information item may include, by way of example only, a tagged physical object, hand-written data, and/or data obtained through touch or voice recognition. Methods and systems for integrating physical information items and electronic information items in a single display location are also provided.

14 Claims, 5 Drawing Sheets

COMPUTERIZED METHOD AND SYSTEM FOR GENERATING A DISPLAY HAVING A PHYSICAL INFORMATION ITEM AND AN ELECTRONIC INFORMATION ITEM

CROSS-REFERENCE TO RELATED APPLICATIONS

Not Applicable.

STATEMENT REGARDING FEDERALLY SPONSORED RESEARCH OR DEVELOPMENT

Not Applicable.

TECHNICAL FIELD

The present invention relates to computing environments. More particularly, embodiments of the present invention relate to methods and systems for generating a display, for instance, on an integrated message board, the display having at least one physical information item and at least one electronic information item. The physical information item may include, by way of example only, a tagged physical object, hand-written data, and/or data obtained through touch or voice recognition. Embodiments of the present invention further relate to methods and systems for integrating physical information items and electronic information items in a single display location.

BACKGROUND OF THE INVENTION

A variety of message boards are available in the marketplace today. Examples include conventional cork and/or pushpin boards, dry erase boards, and electronic whiteboards that capture handwriting and/or illustration data. Each of these types of message boards has certain advantages. For instance, conventional cork and/or pushpin boards permit the display of physical objects thereon while electronic whiteboards permit the conversion of physically written information into an electronic format for distribution over a network. However, when selecting a message board, users often have to settle for one set of advantages or another, or utilize multiple types of message boards simultaneously, as the advantages offered by different kinds of boards are often disparate.

Accordingly, a message board that offers the sets of advantages provided by different types of message boards would be desirable. Additionally, a method of displaying information, both electronic and physical, in a single location would be advantageous.

BRIEF SUMMARY OF THE INVENTION

Embodiments of the present invention relate to a method for generating a display having at least one electronic information item and at least one physical information item. In one embodiment, the method includes receiving at least one electronic information item, receiving at least one physical information item, determining if the physical information item obstructs the view of the electronic information item and, if not, displaying the electronic information item and the physical information item. If the physical information item does obstruct the view of the electronic information item, the method may further include reorienting the electronic information item such that the view is not obstructed prior to displaying the electronic information item and the physical information item.

Embodiments of the present invention further relate to a method for generating a display having at least one electronic information item derived from a physical information item. In one embodiment, the method includes providing a display, receiving an indication that a physical information item has been received at a first location on the display, the physical information item having a tag indicative of information associated with the physical information item, accessing the information associated with the physical item, and displaying an electronic information item in a second location on the display, the electronic information item derived from the information associated with the physical item.

Computer systems and computer-readable media having computer-executable instructions for performing the methods disclosed herein are also provided.

BRIEF DESCRIPTION OF THE SEVERAL VIEWS OF THE DRAWING

The present invention is described in detail below with reference to the attached drawing figures, wherein.

DETAILED DESCRIPTION OF THE INVENTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of the methods employed, the terms should not be interpreted as implying any particular order among or between various steps herein disclosed unless and except when the order of individual steps is explicitly described.

Embodiments of the present invention provide methods and systems for generating a display, for instance, on an integrated message board, the display having at least one physical information item and at least one electronic information item. The physical information item may include, by way of example only, a tagged physical object, hand-written data, and/or data obtained through touch or voice recognition. Embodiments of the present invention further relate to methods and systems for integrating physical information items and electronic information items in a single display location.

Having briefly described an overview of the present invention, an exemplary operating environment for the present invention is described below.

Figure 1:
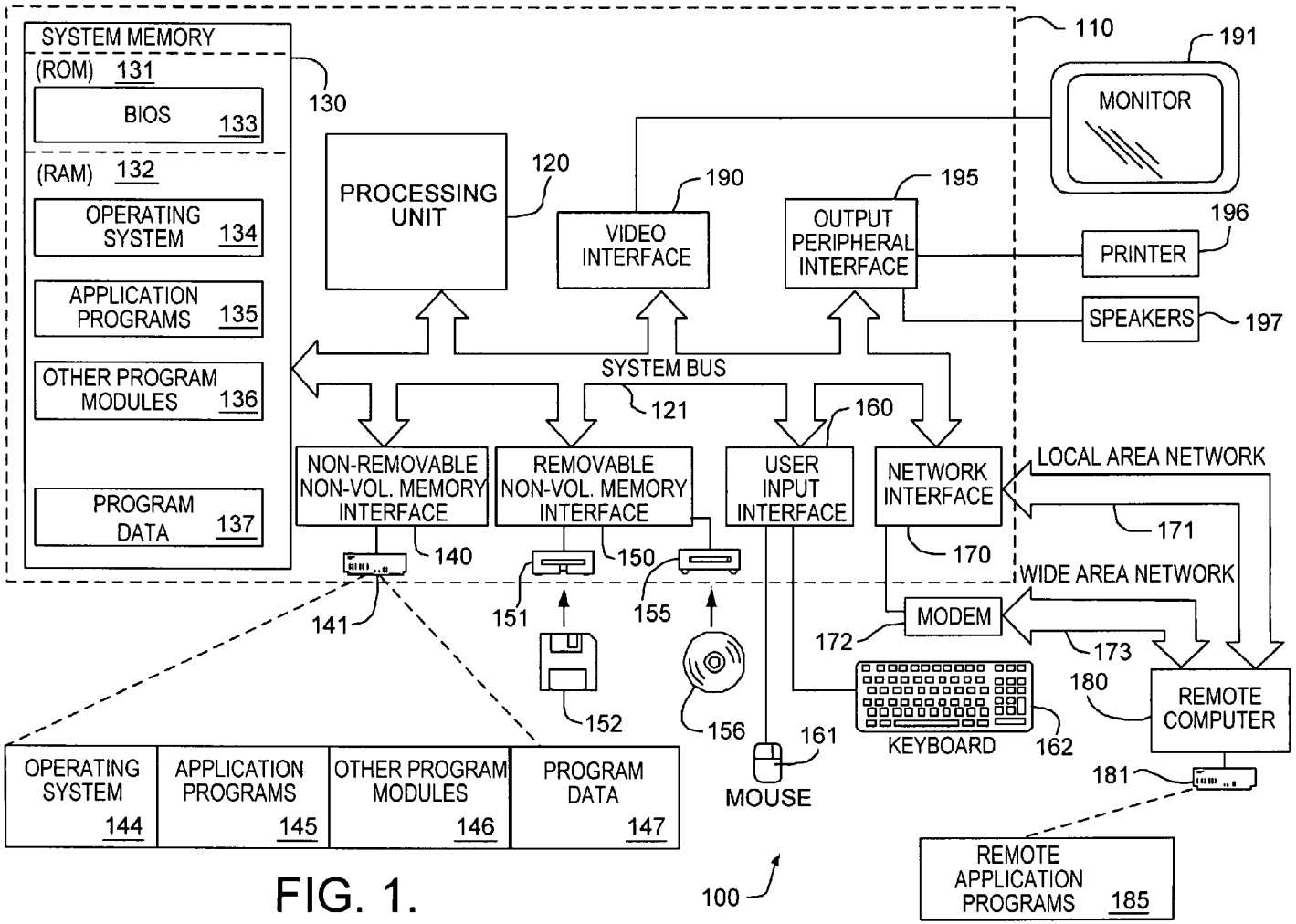
FIG. 1 is a block diagram of an exemplary computing environment suitable for use in implementing the present invention.

Referring to the drawings in general and initially to FIG. 1 in particular, wherein like reference numerals identify like components in the various figures, an exemplary operating environment for implementing the present invention is shown and designated generally as computing system environment 100. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer. Generally, program modules include routines, programs, objects, components, data structures, etc., that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices.

With continued reference to FIG. 1, an exemplary system for implementing the present invention includes a general purpose computing device in the form of a computer 110. Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer-readable media. Computer-readable media can be any available media that can be accessed by computer 110 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 110. Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer-readable media.

The system memory 130 includes computer storage media in the form of volatile and/or nonvolatile memory such as read only memory (ROM) 131 and random access memory (RAM) 132. A basic input/output system (BIOS) 133, containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable, volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks (DVDs), digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer-readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other programs 146 and program data 147 are given different numbers here to illustrate that, at a minimum, they are different copies. A user may enter commands and information into the computer 110 through input devices such as a keyboard 162 and pointing device 161, commonly referred to as a mouse, trackball or touch pad. Other input devices (not shown) may include a microphone, joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device is also connected to the system bus 121 via an interface, such as a video interface 190. In addition to the monitor 191, computers may also include other peripheral output devices such as speakers 197 and printer 196, which may be connected through an output peripheral interface 195.

The computer 110 may operate in a networked environment using logical connections to one or more remote computers, such as a remote computer 180. The remote computer 180 may be a personal computer, a server, a router, a network PC, a peer device or other common network node, and typically includes many or all of the elements described above relative to the computer 110, although only a memory storage device 181 has been illustrated in FIG. 1. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the network interface 170, or other appropriate mechanism. In a networked environment, program modules depicted relative to the computer 110, or portions thereof, may be stored in a remote memory storage device. By way of example, and not limitation, FIG. 1 illustrates remote application programs 185 as residing on memory device 181. It will be appreciated that the network connections shown are exemplary and other means of establishing a communications link between the computers may be used.

Although many other internal components of the computer 110 are not shown, those of ordinary skill in the art will appreciate that such components and the interconnection are well known. Accordingly, additional details concerning the internal construction of the computer 110 need not be disclosed in connection with the present invention.

When the computer 110 is turned on or reset, the BIOS 133, which is stored in the ROM 131, instructs the processing unit 120 to load the operating system, or necessary portion thereof, from the hard disk drive 141 into the RAM 132. Once the copied portion of the operating system, designated as operating system 144, is loaded in RAM 132, the processing unit 120 executes the operating system code and causes the visual elements associated with the user interface of the operating system 134 to be displayed on the monitor 191. Typically, when an application program 145 is opened by a user, the program code and relevant data are read from the hard disk drive 141 and the necessary portions are copied into RAM 132, the copied portion represented herein by reference numeral 135.

Figure 2:
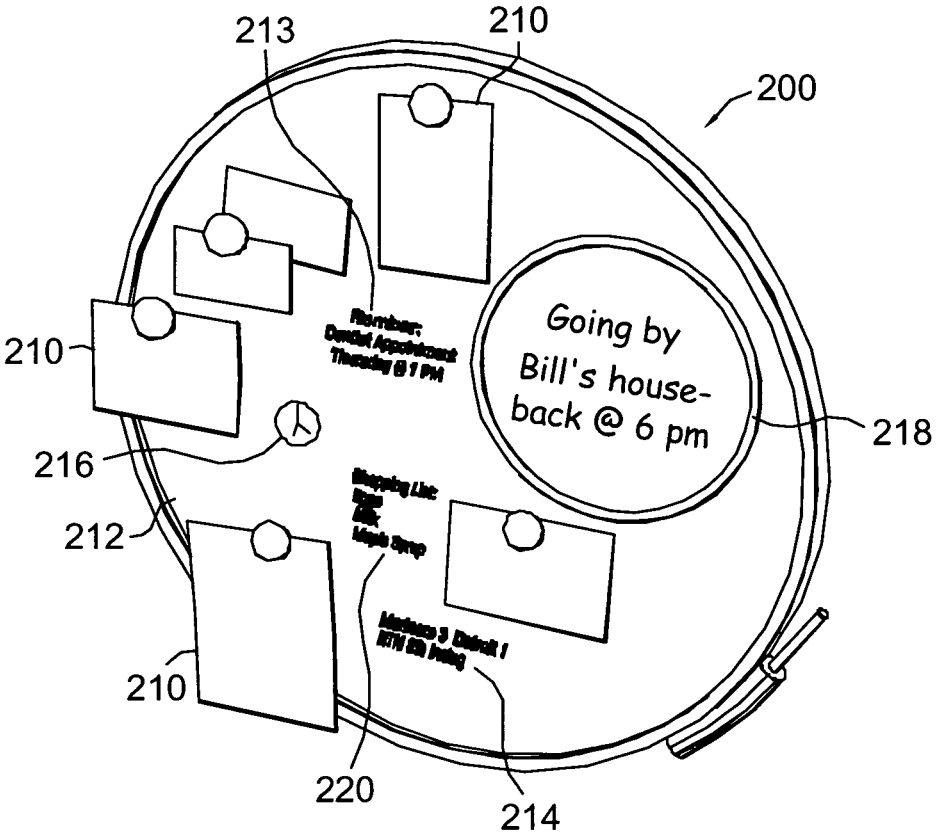
FIG. 2 is a schematic diagram of an exemplary integrated message board, in accordance with an embodiment of the present invention.

As previously mentioned, embodiments of the present invention provide methods and systems for integrating physical information items and electronic information items in a single display location. In one embodiment, the display location may be an integrated message board as illustrated in FIG. 2 and designated generally as reference numeral 200. The integrated message board 200 of FIG. 2 is circular in shape, although it will be understood and appreciated by those of ordinary skill in the art that an integrated message board in accordance with embodiments of the present invention may be a variety of shapes and sizes and all such variations are contemplated to be within the scope hereof.

The integrated message board may be constructed, at least in part, from a textile material that is both touch sensitive (supporting interactivity) and capable of illuminating data much like a large flat screen display panel. It one embodiment, the bulletin board may be connected to a LAN as hereinabove described with reference to FIG. 1.

The integrated message board 200 of FIG. 2 includes a plurality of physical object display areas 210, each of which includes a magnetic back plate that permits magnets to suspend physical objects therefrom. If desired, the physical objects displayed may include tags, e.g., Radio Frequency Identification (RFID) tags, associated therewith from which additional information may be accessed, as more fully described below with reference to FIG. 3. It will be understood and appreciated by those of ordinary skill in the art that RFID is not the only mode of recognition for physical objects. Other wireless communication with a unique ID or barcode, for example, may be utilized, as well as visual object recognition through cameras and the like. All such variations, and any combination thereof, are contemplated to be within the scope of embodiments of the present invention.

The message board 200 of FIG. 2 additionally includes an electronic information display area 212 for displaying electronic information of interest to the user extracted directly from a tagged physical information item or over a network, each variation being described more fully below. The electronic information may include, by way of example only, a sports or stock ticker 214 and/or a digital clock 216.

In one embodiment, the integrated message board 200 additionally includes a handwriting interface portion 218 which appears much like a conventional chalk board or white board. However, using, e.g., a digital stylus, a user may enter a message on the handwriting interface portion 218. Additionally, instead of using a digital stylus, the writing surface area may be pressure sensitive and able to extract the meaning of data written thereon. Thus, for example, an erasable marker applied to the surface may be digitally interpreted and converted, as more fully described below. Subsequently, a handwriting conversion application may be invoked and the handwritten information may be converted into electronic type on the electronic information display area 212. This conversion may be performed locally through any combination of handwriting conversion hardware and software components.

An example of this functionality is indicated by the shopping list 220 shown on the electronic information display area 212. A method for generating a display having an electronic information item derived from a hand-written information item, in accordance with an embodiment of the present invention, is more fully described below with reference to FIG. 4.

The information may also be sent to or derived from networked personal calendars or time management systems, as indicated at reference numeral 213 and more fully described below.

In one embodiment, the integrated message board 200 automatically senses when tagged physical information items are posted on the board and dynamically moves or scales electronic content if necessary to prevent viewing obstructions. The tag can also invoke new electronic data, as the system is capable of querying databases or networked services for appropriate content and then displaying it in proximity to the physical information item. If the newly displayed electronic content prompts some type of user interaction, e.g., selection of electronic "accept" or "reject" buttons, the electronic information display area 212 can function as a touch screen and register a click by sensing pressure applied thereto. When any item with an embedded tag is placed on the board, the currently displayed electronic content scales and repositions itself (as necessary) to maintain balanced distribution, readability, and to make room for new electronic content to appear. Each of these functions is more fully described below.

Figure 3A:
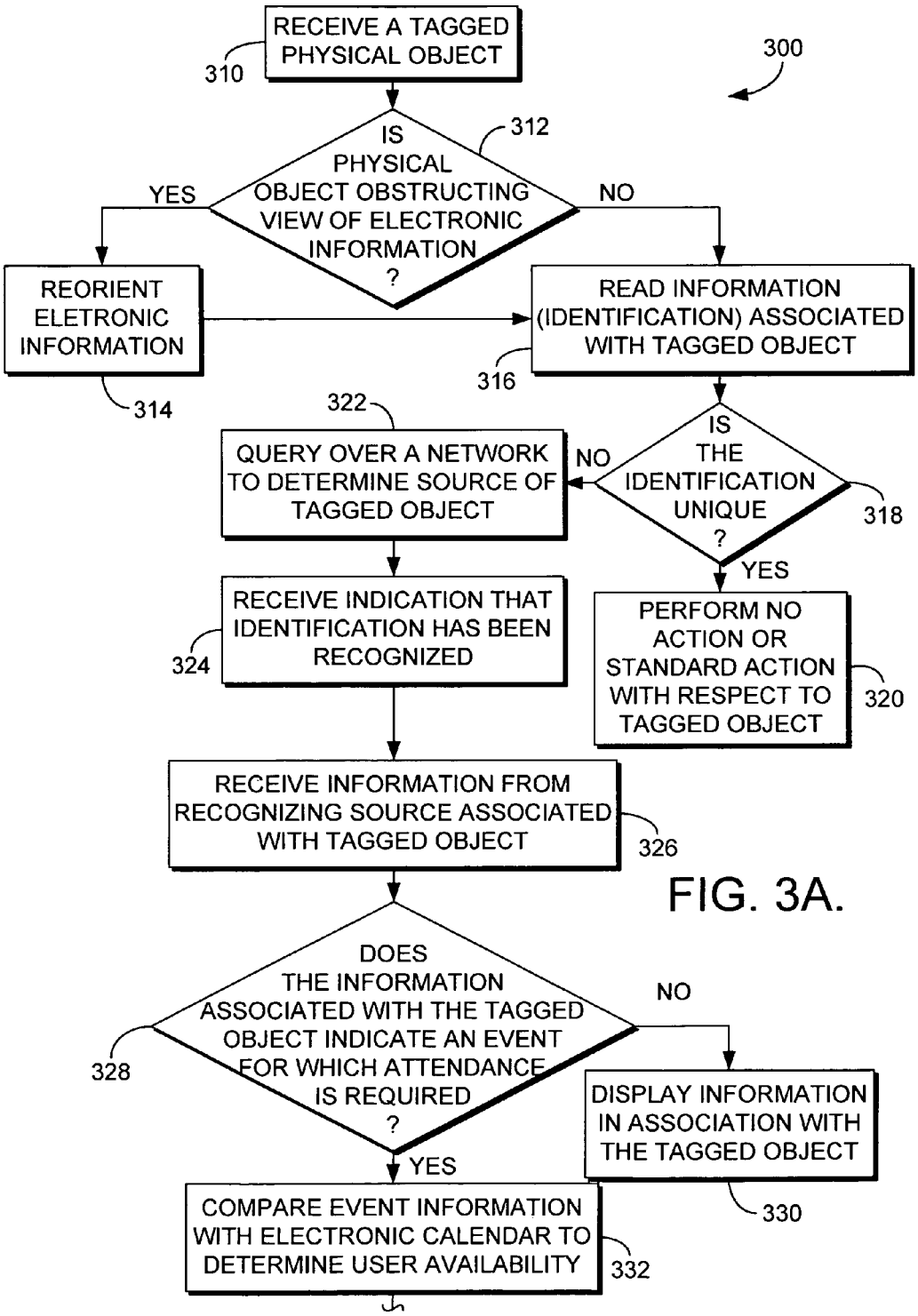
FIG. 3 is a flow diagram illustrating a method for generating a display having an electronic information item derived from a tagged physical object, in accordance with an embodiment of the present invention.
Figure 3B:
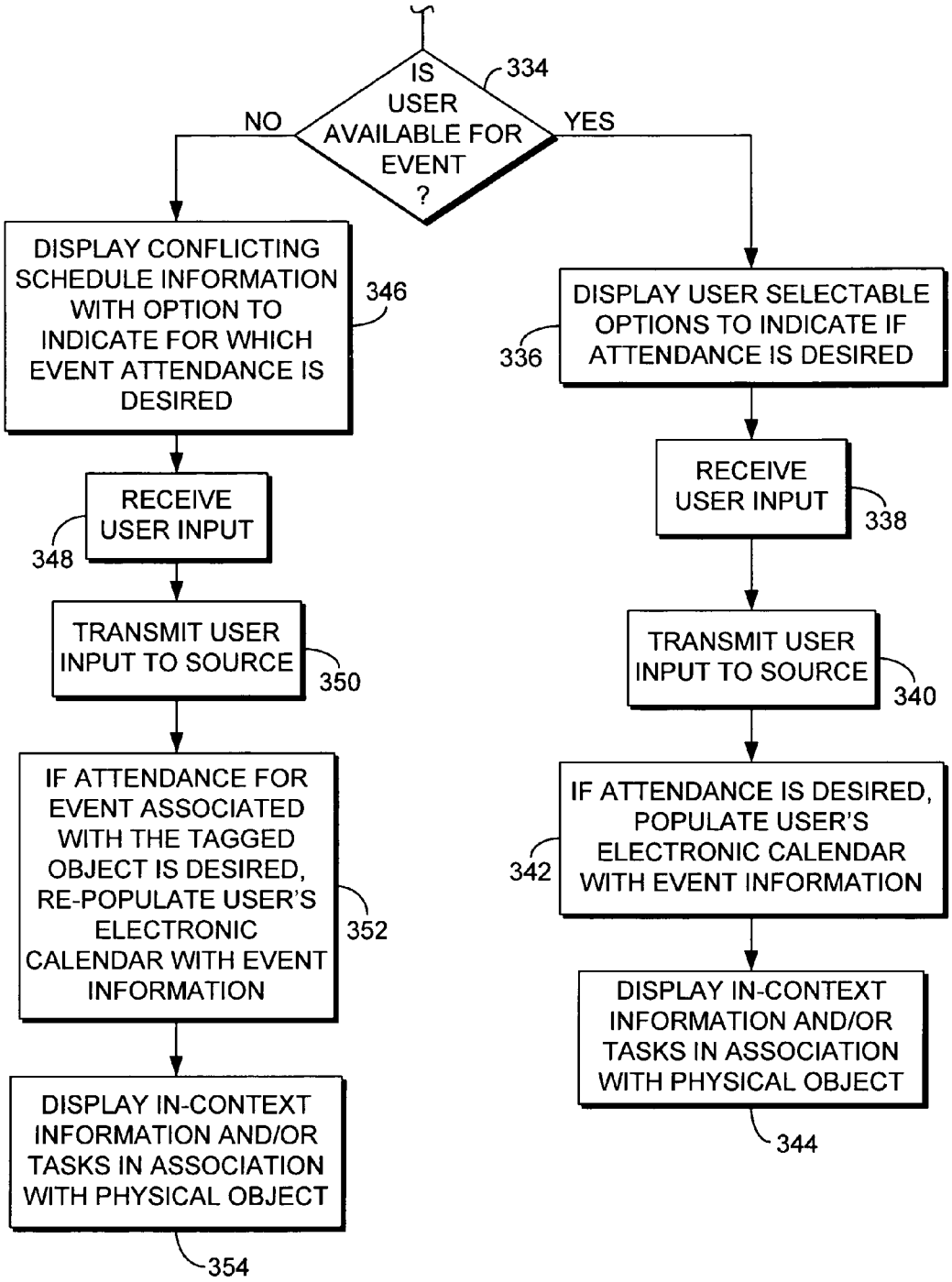

Turning now to FIG. 3, a flow diagram is illustrated which shows a method 300 for generating a display having an electronic information item derived from a tagged physical information item or object, in accordance with an embodiment of the present invention. Initially, a tagged physical object is received on an integrated board, for instance, the integrated message board 200 shown in FIG. 2. This is indicated at block 310. Tagged physical objects are physical objects having a tag, for instance, a Radio Frequency Identification (RFID) tag, associated therewith. The tag includes information stored therein which may be accessed and read by the system associated with the integrated board. This information typically includes at least a unique identifier that the system associated with the integrated board can utilize to access additional information concerning the tagged item, as more fully described below. The associated information may further be included as metadata contained within the tag itself and may be accessed and read without the use of a network. All such variations, and any combination thereof, are contemplated to be within the scope of embodiments of the present invention.

Next, it is determined whether the tagged physical object is obstructing the view of any electronic information displayed on the integrated board. This is indicated at block 312. If the tagged physical object is obstructing the view of any electronic information being displayed on the integrated board, the electronic information is scaled and/or reoriented, as indicated at block 314, such that no obstruction of information occurs. Additionally, such scaling and reorientation maintains balanced distribution and readability, and ensures that room is available for new electronic information to be displayed.

To determine whether the tagged physical object is obstructing the view of any electronic information displayed on the integrated board, the integrated board may have touch sensitive capabilities that allow it to sense the boundaries of the physical object. Additionally or alternatively, the information associated with the tag may include size and shape information regarding the physical object itself. If such information is stored in association with the tag, the step indicated by block 316 of the method 300 of FIG. 3 may take place prior to the step indicated at block 314. If desired, cameras may be utilized to determine size and placement of the tagged physical objects to aid in scaling and reorientation.

Once the information on the integrated board is scaled and reoriented such that all information on the board is readable, or if it is determined at the step indicated by block 312 that the tagged physical object is not obstructing the view of any electronic information displayed on the board, the information/identification associated with the tagged object is read by the system associated with the integrated board. This is indicated at block 316. Next, it is determined whether the identification is unique, that is, whether the identification is recognized by the system. This is indicated at block 318.

If the identification is not unique and is recognized by the system as a known or recurring physical object, the system may either perform no action with respect to the physical object or a standard action that is generally performed when the object is received by the integrated board. This is indicated at block 320. However, if the identification is determined to be unique, the system associated with the integrated board transmits a query over a network in an attempt to determine the source of the tagged object. This is indicated at block 322. Subsequently, an indication is received that a source has recognized the identification, as indicated at block 324. It should be noted that if the identification is not recognized by any source in the network after the query is transmitted, the system may either perform no action with respect to the physical object or may display an electronic message on the integrated board in proximity to the physical object indicating that it is not a recognized object.

Upon receiving an indication that a source has recognized the identification, the system associated with the integrated board receives information from the recognizing source, the information being associated with the tagged physical object. This is indicated at block 326. The information may include the same information that is displayed on the physical information item itself or may be additional information associated therewith.

Subsequently, it is determined whether or not the information associated with the tagged object, that is, the information received from the recognizing source, indicates an event for which attendance and/or scheduling is requested. This is indicated at block 328. If the information does not indicate an event for which attendance and/or scheduling is requested, the information may be displayed on the integrated board in association with the tagged object, e.g., in proximity thereto, as indicated at block 330.

If, however, the information received from the recognizing source indicates an event for which attendance/scheduling is requested, the event information (i.e., the date and time of the event, etc.) is compared to at least one electronic calendar that is networked to the integrated board. This is indicated at block 332. It should be noted that the information received from the recognizing source likely includes a name or other identification of the individual to whom the event pertains. Thus, if the integrated board is networked to the electronic calendars of multiple individuals, for instance, several members of a household, the electronic calendar for the appropriate individual is the only calendar to which the information would be compared. However, if the attendance of multiple individuals, e.g., family members, is requested, the electronic calendars for all appropriate individuals are compared to the received information.

It is next determined whether the user(s) is available for the event or if there is a scheduling conflict in the electronic calendar(s). This is indicated at block 334. If the user is available for the event (that is, if there is no scheduling conflict), the event information is displayed on the integrated board in association with user-selectable options for indicating if the individual(s) desires to attend the event. This is indicated at block 336. Subsequently, user input is received regarding whether or not the individual desires to attend the event, as indicated at block 338. In one embodiment, the user-selectable options are presented on a touch sensitive area of the integrated board so that the user may simply touch the appropriate option using a digital stylus, or the like.

It will be understood and appreciated by those of ordinary skill in the art that the entire integrated board may respond to touch or only specific portions thereof, as desired. Further, embodiments of the present invention may permit the acceptance of user input not only through touch but also through voice recognition. All such variations, and any combination thereof, are contemplated to be within the scope of embodiments of the present invention.

Next, as indicated at block 340, the user input is transmitted to the source, if necessary. In one embodiment, transmittal of such information may be all that is necessary for the user's acceptance or rejection to be communicated to the individual or entity hosting the event. However, other means of communicating this information to the host may be necessary and, if they are, the acceptance or rejection information may not need to be transmitted. All variations are contemplated to be within the scope hereof.

Subsequently, if the user input indicates that attendance is desired, the user's electronic calendar is automatically populated with the event information, as indicated at block 342. Once in the user's calendar, in-context information and/or tasks may be displayed on the integrated board in association with the tagged physical object, e.g., in proximity thereto, as indicated at block 344. Such in-context information and/or tasks may include, by way of example only, a reminder of the date and time of the event, a reminder to hire a babysitter or purchase a host gift, or the like.

Referring back to block 334, if it is determined that the user is not available for the event, that is, if it is determined that there is a scheduling conflict, the conflicting schedule information is subsequently displayed on the integrated board with a user-selectable option to indicate for which event attendance is desired. This is indicated at block 346. Subsequently, user input is received, as indicated at block 348, setting forth which of the conflicting events he/she wishes to attend. Next, if necessary, the user's acceptance or rejection for attendance of the event associated with the tagged physical object is transmitted to the source, as indicated at block 350.

If attendance for the event associated with the tagged physical object is desired, the user's electronic calendar is automatically re-populated with the event information, as indicated at block 352. Once in the user's calendar, in-context information and/or tasks may be displayed on the integrated board in association with the tagged physical object, e.g., in proximity thereto, as indicated at block 354. Such in-context information and/or tasks may include, by way of example only, a reminder of the date and time of the event, a reminder to hire a babysitter or purchase a host gift, a reminder to send a regret to the host of the previously scheduled event, or the like.

Figure 4:
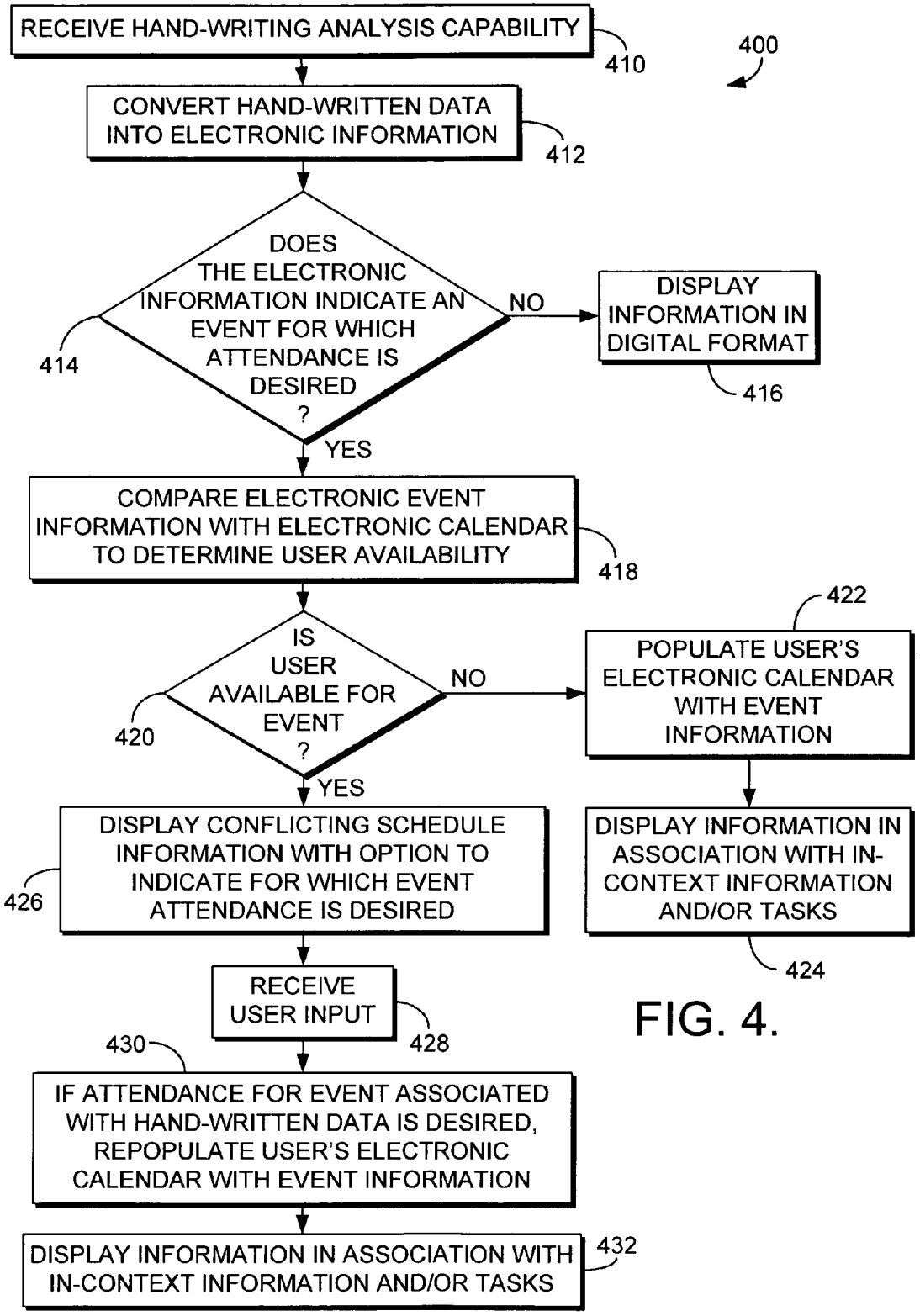
FIG. 4 is flow diagram illustrating a method for generating a display having an electronic information item derived from a hand-written information item, in accordance with an embodiment of the present invention.

The method hereinabove described provides a method for generating a display having an electronic information item derived from a tagged physical object. Turning now to FIG. 4, a flow diagram is illustrated which shows a method 400 for generating a display having at least one electronic information item extracted from a handwritten information item. Initially, as indicated at block 410, hand-written information item is received on an integrated interface having handwriting analysis capability. This interface may be, for instance, the handwriting interface portion 218 of the integrated bulletin board 200 of FIG. 2. Subsequently, a handwriting analysis application associated with the interface reads the hand-written information item and converts it into an electronic information item, as indicated at block 412.

Subsequently, it is determined whether the electronic information item indicates an event for which attendance is requested/desired, as indicated at block 414. If it does not indicate an event for which attendance is requested/desired, the electronic information item may be displayed on the integrated board, e.g., in proximity to the interface, as indicated at block 416. In this way, if a user desires to erase or otherwise eliminate the hand-written information, the content of that information will persist on the integrated board in the way of an electronic information item until such time as the user deletes the information.

If, however, the electronic information item indicates an event for which attendance is requested/desired, the system associated with the integrated board compares the electronic event information (e.g., the date and time of the event, etc.) with at least one electronic calendar or time management system that is networked to the integrated board. This is indicated at block 418. It should be noted that the hand-written information item received likely includes a name or other identifier of the individual to whom the event pertains. Thus, if the integrated board is networked to the electronic calendars of multiple individuals, for instance, several members of a household, the electronic calendar for the appropriate individual is the only calendar to which the information would be compared. However, if the attendance of multiple individuals, e.g., family members, is requested/desired, the electronic calendars for all appropriate individuals are compared to the electronic information.

It is next determined whether the user(s) is available for the event or if there is a scheduling conflict in the electronic calendar(s). This is indicated at block 420. If the user is available for the event (that is, if there is no scheduling conflict), the user's electronic calendar is automatically populated with the event information, as indicated at block 422. Once in the user's calendar, in-context information and/or tasks may be displayed on the integrated board in association with the hand-written information item, e.g., in proximity thereto, as indicated at block 424. Such in-context information and/or tasks may include, by way of example only, a reminder of the date and time of the event, a reminder to hire a babysitter or purchase a host gift, or the like.

If, however, it is determined at the step indicated at block 420 that the user is not available for the event, that is, if it is determined that there is a scheduling conflict, the conflicting schedule information may subsequently be displayed on the integrated board with a user-selectable option to indicate for which event attendance is desired. This is indicated at block 426. Subsequently, user input is received, as indicated at block 428, setting forth which of the conflicting events he/she wishes to attend.

If attendance for the event associated with the hand-written information is desired, the user's electronic calendar is automatically re-populated with the event information, as indicated at block 430. Once in the user's calendar, in-context information and/or tasks may be displayed on the integrated board in association with the hand-written information item, e.g., in proximity thereto, as indicated at block 432. Such in-context information and/or tasks may include, by way of example only, a reminder of the date and time of the event, a reminder to hire a babysitter or purchase a host gift, a reminder to send a regret to the host of the previously scheduled event, or the like.

As will be understood, the present invention relates to methods and systems for generating a display, for instance, on an integrated message board, the display having at least one physical information item and at least one electronic information item. The above-described examples set forth scenarios wherein the physical information contains information related to an event for which attendance is desired/requested. However, the physical information items may also relate to other types of information, for instance, advertisements and the like. By way of example only, contemplate a scenario wherein a magnet, e.g., a refrigerator magnet, is received that has a tag associated therewith. If the magnet is placed on the integrated message board, the tag may permit access to coupons, specials, and the like which will be displayed on the board.

The system associated with the integrated board may also be capable of filtering messages that may be associated with a tagged physical information item based on user preferences, which are programmed by the user and uploaded to the integrated board. For example, if the magnet in the above-described scenario advertises the services of a local business, the tag associated therewith might try to spawn additional electronic advertisements to appear alongside it by accessing a remote database. The user can choose whether or not to allow this to happen. Thus, data filtering is completely controllable by the user.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated and within the scope of the claims.

What is claimed is:

1. A computer-implemented method for generating a display having at least one electronic information item and at least one physical information item, the method comprising:

receiving a plurality of electronic information items and causing each electronic information item of the plurality of electronic information items to be displayed at a first respective location on a display;

determining that the at least one physical information item is in communication with the display;

determining whether the at least one physical information item obstructs a view of an electronic information item of the plurality of electronic information items;

if the at least one physical information item does not obstruct the view of the electronic information item, allowing each electronic information item of the plurality of electronic information items to be displayed at the first respective location; and if the at least one physical information item does obstruct the view of the electronic information item, causing each electronic information item of the plurality of electronic information items to be reoriented to a second respective location, thereby rebalancing a presentation of the display and preventing viewing obstructions.

2. A computer-implemented method for generating a display having a new electronic information item derived from a physical information item, the method comprising:

receiving an indication that the physical information item has been received at a first location on the display, wherein the physical information item comprises a physical boundary and wherein the physical information item obstructs a portion of the display;

in response to determining that the physical information item obstructs a first view of any electronic information displayed, one or more of reorienting and rescaling the any electronic information to be displayed in a second view that is not obstructed by the physical information item;

reading information provided by the physical information item; and displaying the new electronic information item in a second location on the display, the new electronic information item being derived from the information provided by the physical information item, wherein the second location is at least partially outside the physical boundary of the physical information item and wherein the new electronic information item is not obstructed by the physical information item, which obstructs the portion of the display.

3. The method of claim 2, wherein the display comprises a networked display, wherein receiving an indication that a physical information item has been received at a first location on the networked display comprises receiving an indication that a physical information item has been received at the first location on the display, the physical information item having a tag including an identifier stored therein, and wherein the method further comprises transmitting a query over a network to determine a source of the physical information item based upon the identifier stored in the tag.

4. The method of claim 2, wherein receiving an indication that a physical information item has been received at a first location on the display comprises receiving an indication that a hand-written physical information item has been received at the first location on the display.

5. The method of claim 4, wherein accessing the information associated with the physical item comprises converting the hand-written information item into the electronic information item.

6. The method of claim 2, wherein receiving an indication that a physical information item has been received at a first location on the display comprises receiving an indication that a physical object has been received at the first location on the display.

7. The method of claim 6, further comprising:

determining if at least one additional electronic information item is displayed on the display;

if at least one additional electronic information item is displayed on the display, determining if the physical object is obstructing a view of the at least one additional electronic information item; and if the physical object is obstructing the view of the at least one additional electronic information item, reorienting the at least one additional electronic information item such that the view is not obstructed.

8. The method of claim 2, further comprising:

determining if the information associated with the physical item is indicative of an event for which attendance is requested; and if the information associated with the physical item is indicative of an event for which attendance is requested, comparing the event information with at least one electronic time management system to determine attendance availability.

9. The method of claim 8, wherein if attendance availability is determined, the method further comprises providing one or more user-selectable indicators, selection of which indicates whether attendance is planned.

10. The method of claim 9, further comprising:

receiving user input that attendance of the event is planned; and populating the electronic time management system with the event information.

11. The method of claim 10, further comprising displaying the event information in proximity to the physical information item.

12. A computer-system memory storing computer-executable instructions for generating a display having at least one electronic information item derived from a physical information item, the instructions configured to execute steps comprising:

providing a display on an integrated message board having a physical object display area capable of suspending physical objects therefrom; receiving an indication that the physical information item has been received at a first location on the display, wherein the physical information item comprises a physical boundary; reading information provided by the physical information item; determining that the information provided by the physical information item is indicative of an event for which attendance is requested, and comparing the information with at least one electronic time management system to determine attendance availability; and displaying an electronic information item in a second location on the display, wherein the electronic information item is derived from the information provided by the physical information and wherein the second location is at least partially outside the physical boundary of the physical information item.

13. The computer-system memory storing computer-executable instructions of claim 12, wherein if attendance availability is determined, the computer-readable storage medium further comprises instructions configured for receiving user input that attendance of the event is planned and instructions configured for populating the electronic time management system with the event information.

14. The computer-system memory storing computer-executable instructions of claim 13, further comprising instructions configured for displaying the event information in proximity to the physical information item.

* * * * *